United States Patent [19]

Oltman, Jr. et al.

[11] 3,946,339

[45] Mar. 23, 1976

[54] SLOT LINE/MICROSTRIP HYBRID

[75] Inventors: Henry G. Oltman, Jr., Woodland Hills; Nathan Pelner, Los Angeles; Eugene N. Torgow, Northridge, all of Calif.

[73] Assignee: Hughes Aircraft Company, Culver City, Calif.

[22] Filed: Nov. 29, 1974

[21] Appl. No.: 528,045

[52] U.S. Cl. ..... 333/11; 333/10; 333/84 M

[51] Int. Cl.[2] ..... H01P 5/16

[58] Field of Search ..... 333/10, 84 R, 84 M, 11

[56] References Cited

UNITED STATES PATENTS

| | | | |
|---|---|---|---|
| 3,768,047 | 10/1973 | Campbell et al. | 333/84 M |
| 3,772,599 | 11/1973 | Ernst et al. | 333/84 R |
| 3,886,500 | 5/1975 | Baril et al. | 333/11 |

OTHER PUBLICATIONS deRonde, *A New Class of Microstrip Directional Couplers*, Dig. of Tech. Papers of GMTT 1970, Int'l. Microwave Symposium, 5/70.

*Primary Examiner*—Paul L. Gensler

*Attorney, Agent, or Firm*—John Holtrichter, Jr.; W. H. MacAllister

[57] ABSTRACT

A broadband 180° 3 db hybrid coupler useful in mixing, combining and/or splitting circuits, the hybrid including slot line and microstrip hybrid components disposed on opposite planar surfaces of a dielectric substrate, one of the components having three ports and associated arms while the other component having a single port and arm, the hybrid providing signal coupling between the hybrid components except where the plane of symmetry of one of the hybrid components bisects the other hybrid component.

3 Claims, 7 Drawing Figures

Fig. 6.
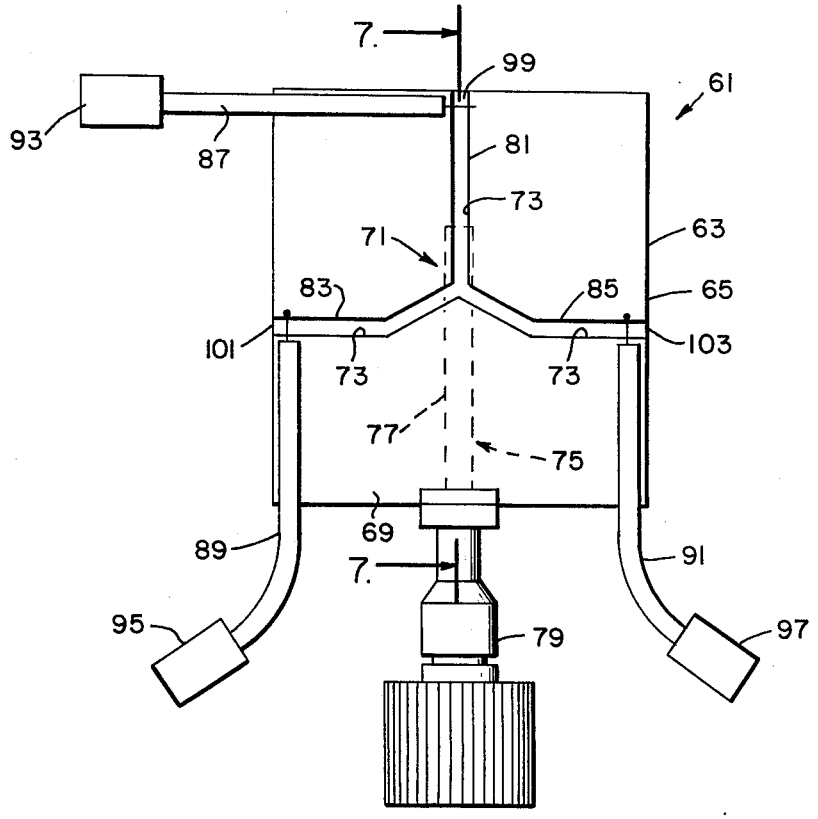
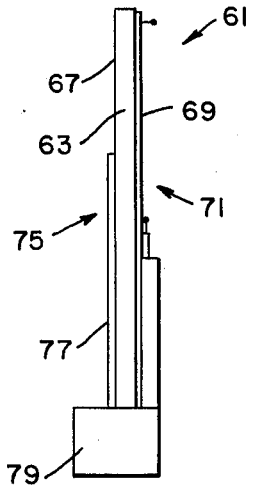
Fig. 7.

SLOT LINE/MICROSTRIP HYBRID

BACKGROUND OF THE INVENTION

The background of the invention will be set forth in two parts.

1. Field of the Invention

This invention relates to an electromagnetic wave propagating device and more particularly to a microwave 180° 3 db hybrid coupler utilizing slot line and microstrip techniques.

2. Description of the Prior Art

Microwave devices known as hybrids or hybrid junctions have been in use for many years. Hybrids are four-port devices which, relative to one port chosen as the input, produce one isolated port and two coupled ports. Many of these hybrids have used hollow waveguide, and others have used microwave integrated circuit techniques. One such device used in integrated circuit applications is a branch line coupler. This device uses differential electrical line lengths to produce the required signals at the output ports. For isolation, two equal amplitude signals are phased 180° apart by differential line lengths which are then summed at its isolation port. The relative phase difference between its two coupled ports is 90°. In this type of device, the differential electrical length varies with frequency, therefore so does the isolation and the relative phase of its coupled ports.

Another example of a prior art device of this type is the 3 db reverse coupler, which has two lengths of line coupled to each other over a quarter wavelength. The coupling and isolation are a function of the electrical length of this coupled section, making it frequency sensitive.

It should therefore be evident that an integrated circuit-type hybrid coupler that does not utilize differential lengths of line to achieve isolation or coupling because it has a natural isolation between its input and output ports, would constitute a significant advancement of the art.

SUMMARY OF THE INVENTION

In view of the foregoing factors and conditions characteristic of the prior art, it is a primary object of the present invention to provide a new and improved hybrid coupler.

Another object of the present invention is to provide a broadband hybrid coupler that is very compact in size and which achieves its broadband characteristics in an integrated circuit-type structure through symmetry of the circuit.

Still another object of the present invention is to provide a hybrid coupler using both slot line and microstrip techniques.

Yet another object of the present invention is to provide a broadband hybrid coupler including a slot line hybrid component and a microstrip hybrid component, one of the components having three ports and associated arms, and the other component having a single port and associated arm.

In accordance with an embodiment of the present invention, a slot line/microstrip hybrid includes a relatively thin conductive coating disposed on one planar surface of a dielectric substrate having another parallel planar surface, a slot line hybrid component being defined by a relatively narrow slot in the conductive coating. Disposed on the other of the planar surfaces is a microstrip line hybrid component of conductive material, the microstrip hybrid component being disposed relative to the slot line hybrid component to provide signal coupling between the hybrid components except where the plane of symmetry of one of the hybrid components bisects the other hybrid component.

The hybrid is a four-port device, where one of the hybrid components has three ports and associated arms, and the other hybrid component has a single port and an associated arm which may, in certain configurations, be a split arm. Also in various embodiments of the invention, the hybrid component having three ports may be a microstrip line and the other hybrid component having a single port will be a slot line, and vice versa.

The features of the present invention which are believed to be novel are set forth with particularity in the appended claims. The present invention, both as to its organization and manner of operation, together with further objects and advantages thereof, may best be understood by making reference to the following description taken in conjunction with the accompanying drawings in which like reference characters refer to like elements in the several views.

BRIEF DESCRIPTION OF THE DRAWINGS

FIG. 6 is a plan view of a complete slot line/microstrip hybrid, constructed in accordance with the present invention; and FIG. 7 is a side elevational view of the device illustrated in FIG. 6.

DESCRIPTION OF THE PREFERRED EMBODIMENTS

The invention as herein described combines the integrated circuit-type technique known as slot line and microstrip constructions. A slot line may be generally described as a relatively narrow slot in a thin conductive layer disposed on a broad planar surface of a relatively high permittivity dielectric substrate. Upon the application of an input signal, an electric field exists across the slot while the magnetic field is perpendicular to the slot and forms closed loops at half-wave intervals. If the substrate's permittivity is sufficiently high, such as $e_r = 10$ to 30, the slot-mode wavelength will be much smaller than free-space wavelengths, and the fields will be closely confined near the slot.

Microstrip lines are well known and consist of a strip of conductor disposed on one planar surface of a dielectric or ferrite substrate plate with a conductive coating or layer disposed on the other, parallel, planar surface of the substrate. For a more in-depth explanation of the design and operation of slot and microstrip lines, the following articles may be referred to: "Slot Line on a Dielectric Substrate" by Seymour B. Cohn, in IEEE Transactions on Microwave Theory and Techniques, pages 768–778, Vol. MTT-17, No. 10, October 1969; "Slot-Line Filters and Couplers" by E. A. Mariani and J. P. Agrios, in IEEE Transactions on Microwave Theory and Techniques, pages 1089–1095, Vol. MTT-18, No. 12, December 1970; and "Slot Line Application to Miniature Ferrite Devices" by G. H. Robinson and J. L. Allen, IEEE Transactions on Microwave Theory and Techniques, pages 1097–1101, Vol. MTT-17, No. 12, December 1969.

Figure 1:
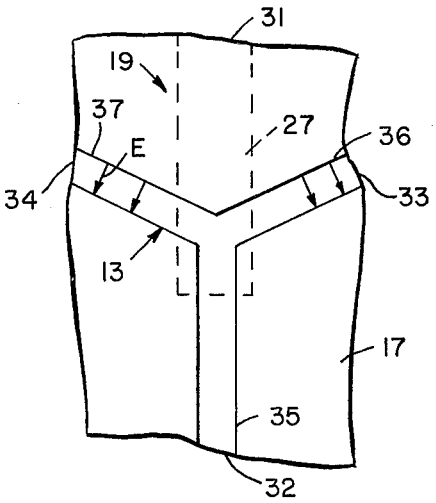
FIG. 1 is a plan view of a portion of a slot line/microstrip hybrid wherein a microstrip line hybrid component couples a signal to a "Y" slot line hybrid component such that signals in two of the arms of the component having three arms are in phase, in accordance with the present invention.
Figure 2:
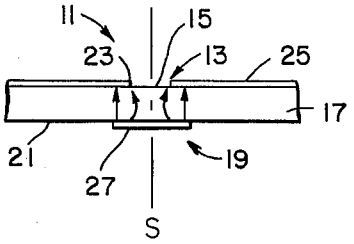
FIG. 2 is a sectional representation of the device shown in FIG. 1, taken along line 2—2.

Referring now to the drawings and more particularly to FIGS. 1 and 2, there is shown a slot line/microstrip 180° 3 db hybrid 11. This embodiment consists of a slot line "Y" junction hybrid component 13 disposed on a first planar surface 15 of a metallized dielectric or ferrite substrate 17, with a microstrip conductor hybrid component 19 disposed by means of etching, for example, on a second, parallel, planar surface 21 of the substrate. Thus, the slot line component is a relatively narrow slot 23 provided in a conductive coating 25 of such material as copper, gold, silver and the like, the coating or layer 25 being applied to the substrate surface 15 by any conventional process. The layer 25 also acts as the ground plane for the microstrip conductor 27 of the hybrid component 19, and except where coupling between the microstrip and slot line hybrid components is desired, two independent integrated circuit-type circuits, one on each side of the substrate 17, exist. Coupling between the two hybrid components is achieved when the slot 23 is in close proximity to the microstrip conductor 27, except under conditions to be described.

It can be seen that the hybrid 11, being provided in integrated circuit type structures, is very compact and lightweight and, due to its circuit symmetry analogous to a waveguide "magic Tee", has a relatively broadband characteristic. In this regard reference may be made to Section 9.12 of Vol. 8, Principles of Microwave Circuits, and Section 8.8 of Vol. 14, Microwave Duplexers, both in the well-known radiation laboratory series of MIT. The hybrid 11 does not require differential lengths of line to achieve isolation of coupling between its components, since it has a natural isolation between its first port 31 of the microstrip component 19 and a hybrid second port 32 of the slot line component 13 at the base of the "Y" configuration, the latter component also including third and fourth hybrid ports 33 and 34, and associated arms 35, 36 and 37.

This natural isolation is achieved by positioning the microstrip line in component 19 such that the plane of symmetry S of the slot line component 13 bisects it, as illustrated in FIG. 2.

Where a microwave input signal is applied to the microstrip component 19 (port 31), the field lines (indicated by arrows E) that terminate on the second hybrid arm 35 (the slot line "Y" junction base) are of equal intensity and, therefore, create no difference of potential between the slot line conductors. A similar effect occurs at the microstrip line component 19 when the input signal is applied to the second arm 35 (port 32) of the slot line components 13.

Figure 3:
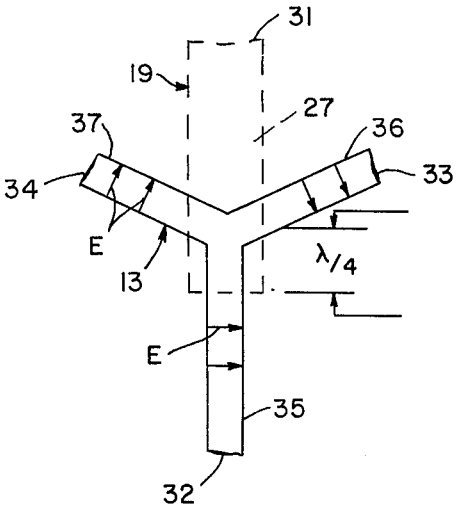
FIG. 3 is a plan view of the hybrid of FIG. 1, wherein the signals in two arms are out of phase.

Thus it can be seen that with an input at port 31, port 32 is isolated and the power is equally split between ports 33 and 34, the signals in the latter arms being in phase. And again, conversely, with an input at port 32, port 31 is isolated and the power is equally split at ports 33 and 34, but these signals are out of phase, as shown in FIG. 3.

Basically, the invention is a broadband device with no cricital resonant length problems. However, for maximum efficiency of energy transfer from one hybrid component to the other, it is preferred that the single port hybrid component overlap or extend beyond the intersection of the arms of the three-port hybrid component by approximately one-quarter wavelength (see FIG. 3).

Figure 4:
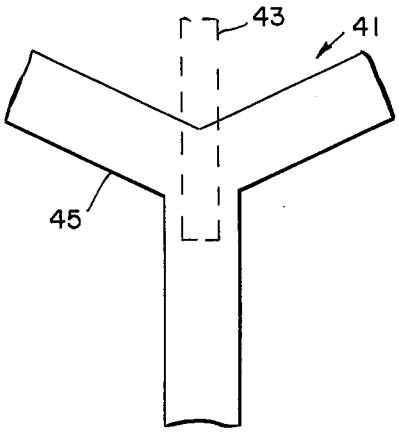
FIG. 4 is a plan view of a portion of a slot line/microstrip hybrid wherein a slot line hybrid component couples a signal to a "Y" microstrip hybrid component, in accordance with another embodiment of the present invention.

Referring now to FIG. 4, there is illustrated another embodiment of the invention. Here, a slot line-microstrip hybrid 41 is shown having a single port slot line hybrid component 43 and a three-port microstrip hybrid component 45 in the form of a Y. Again, the plane of symmetry of the slot line hybrid component bisects the microstrip line hybrid component. The hybrid components function identically to those first described and no additional description is herein provided.

Figure 5:
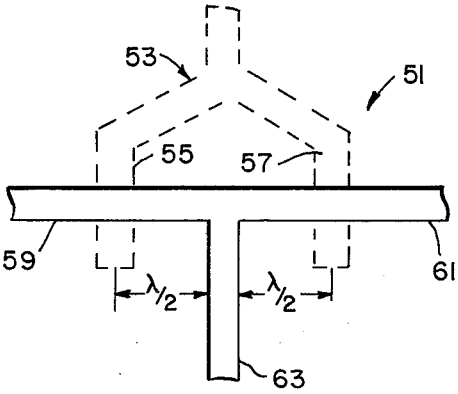
FIG. 5 is a plan view of still another embodiment of the invention including a microstrip line "Y" hybrid component and a slot line "T" hybrid component.

Still another embodiment of the invention is shown in FIG. 5. This figure illustrates a slot line/microstrip hybrid 51 which includes a single port microstrip hybrid component 53 having a Y configuration with two parallel arm portions 55 and 57. These arm portions extend over two arms 69 and 61 of the three-port slot line hybrid component 63 in a T configuration. As in the other embodiments, for maximum efficiency, the arms of the single port hybrid component extend beyond the two arms sharing a common axis of the other hybrid component by approximately one-quarter wavelength. However, for maximum efficiency, the distance from the center of each of the arm portions to the center of the T-junction should preferably be approximately one-half wavelength.

With reference to FIGS. 6 and 7, there is shown an embodiment of the present invention similar to the embodiment illustrated in FIG. 1 as actually constructed. The slot line/microstrip hybrid 61 includes a dielectric substrate 63 having two parallel planar surfaces 65 and 67, a relatively thin conductive coating 69 of copper or silver, for example, being disposed on the surface 65 whereas a slot line hybrid component 71 is defined by a relatively narrow slot 73 in the conductive coating 69.

A microstrip hybrid component 75 of conductive material in the form of a longitudinal strip 77, similar to the conductive coating 69, is disposed on the other planar surface 67, the microstrip hybrid component 75 being disposed relative to the slot line hybrid component 71 to provide signal coupling between the hybrid components except where the plane of symmetry of the slot line hybrid component 71 bisects the microstrip hybrid component 75, as clearly seen in FIG. 6.

In this embodiment, the center conductor of a standard coaxial connector 79 is soldered or otherwise conductively attached to the end of the microstrip conductive coating 77, and signals are coupled into or out of the three arms 81, 83, 85 of the slot line hybrid component 71 by means of three miniature semi-rigid coaxial lines 87, 89 and 91, respectively. As seen in FIG. 6, the outer conductive shield of the three miniature coaxial lines are soldered or conductively epoxied to the coating 69, and each is provided with a miniature coaxial connector 93, 95 and 97, respectively. Signal coupling is provided to each of the three slot line arms by soldering or otherwise conductively attaching the center conductors 99, 101 and 103 of the respective three miniature coaxial lines to the edge of the conductive coating 69 opposite the corresponding end of the miniature line. Thus, the slot line hybrid component 71 has three arms 81, 83 and 85 and three associated connectors or ports 93, 95 and 97, while the microstrip hybrid component 75 has a single arm 77 coupled to the connector or port 79.

In this configuration, with an input signal applied to the port 79, port 93 will be isolated and the applied power will be split equally between ports 95 and 97 and will be in phase. On the other hand, with an input signal applied to port 93, port 79 will be isolated and the applied power will again be split equally in arms 83 and 85 but here the power in the arms will be out of phase with respect to each other.

The hybrids herein described are broadband devices which may be advantageously utilized in many broadband circuits, such as for example, as broadband microminiature balanced mixers, and broadband microminiature sum and difference monopulse circuits. Accordingly, it should be evident that there has herein been described new and improved hybrid couplers that are very rugged and compact, and that have very broad band characteristics, the invention utilizing such integrated circuit techniques as microstrip and slot line structures in a unique combination.

It should be understood that the materials used to fabricate the various embodiments of the invention are not critical and any material exhibiting the desired characteristics may be substituted for those mentioned. It should further be understood that the invention is susceptible to further embodiments embracing the teaching of the invention.

What is claimed is:

1. slot line/microstrip hybrid, comprising:

a dielectric substrate having two parallel planar surfaces;

a relatively thin conductive coating disposed on one of said planar surfaces, a T-shaped three port slot line hybrid component being defined by a relatively narrow slot in said conductive coating;

a split arm single port microstrip line hybrid component of conductive material disposed on the other of said planar surfaces, the longitudinal axes of the portions of the split arm hybrid component adjacent two coaxial arms of said T-shaped hybrid component being on opposite sides of and essentially parallel to the transverse arm of said T-shaped hybrid component.

2. The slot line/microstrip hybrid according to claim 1, wherein said portions of said split arm hybrid component extend beyond said coaxial arms by approximately one-quarter of the design wavelength.

3. The slot line/microstrip hybrid according to claim 1, wherein said portions of said split arm hybrid component are each spaced from said transverse arm by approximately one-half of the design wavelength.

* * * * *